United States Patent [19]

Abe et al.

[11] Patent Number: 5,009,205

[45] Date of Patent: Apr. 23, 1991

[54] CRANKSHAFT SUPPORTING STRUCTURE FOR AN INTERNAL COMBUSTION ENGINE

[75] Inventors: Ryoji Abe, Hiroshima; Junichi Okita, Iwakuni; Katsunobu Miyagoshi, Miyagoshi; Kouichi Hashiyama, Hiroshima, all of Japan

[73] Assignee: Mazda Motor Corporation, Hiroshima, Japan

[21] Appl. No.: 432,998

[22] Filed: Nov. 8, 1989

[30] Foreign Application Priority Data

Nov. 9, 1988 [JP] Japan ..... 63-282965

[51] Int. Cl.[5] ..... F02F 7/00

[52] U.S. Cl. ..... 123/195 H; 123/198 E; 384/429; 384/432

[58] Field of Search ..... 123/195 H, 198 E; 384/429, 432

[56] References Cited

U.S. PATENT DOCUMENTS

| | | | |
|---|---|---|---|
| 4,474,148 | 10/1984 | Kikuchi | 123/195 H |
| 4,656,983 | 4/1987 | Anno | 123/195 H |
| 4,831,978 | 5/1989 | Iguchi et al. | 384/429 |
| 4,856,486 | 8/1989 | Mori et al. | 123/195 H |
| 4,911,117 | 3/1990 | Nishimura et al. | 123/195 H |

FOREIGN PATENT DOCUMENTS

| | | |
|---|---|---|
| 25041 | 3/1981 | Japan . |
| 127832 | 8/1982 | Japan . |
| 110359 | 7/1984 | Japan . |

OTHER PUBLICATIONS

Society of Automotive Engineers No. 770775, 9/77, "Engine Concept and Design", Component Testing and Engine Development.

*Primary Examiner*—David A. Okonsky
*Assistant Examiner*—Weilun Lo
*Attorney, Agent, or Firm*—Fleit, Jacobson, Cohn, Price, Holman & Stern

[57] ABSTRACT

A crankshaft supporting device for a multi-cylinder engine including a plurality of bulkheads provided in a cylinder block of the engine to be arranged along an axis of the crankshaft, disposed in a lower part of the cylinder block. A bearing cap member has a plurality of bearing cap portions each coupled with a lower end of one of the bulkheads so as to constitute a bearing portion for supporting the crankshaft in conjunction with the bulkhead, and a pair of beam portions extending along the axis of the crankshaft to interconnect therethrough two adjacent bearing cap portions. A reinforcement member has a side wall portion which is coupled with a skirt portion of the cylinder block, and a plurality of bolt seats are located underneath the beam portion of the bearing cap member. A plurality of ribs interconnect at least one of the bolt seats and at least one of the side wall portions. A plurality of bolts fasten the beam portions with the bolt seats.

20 Claims, 12 Drawing Sheets

CRANKSHAFT SUPPORTING STRUCTURE FOR AN INTERNAL COMBUSTION ENGINE

BACKGROUND OF THE INVENTION

1. Field of the Invention

The present invention relates generally to a crankshaft supporting structure for an internal combustion engine, which provides for a decrease of vibrations therein.

2. Description of Prior Art

A crankshaft supporting structure for an internal combustion engine has been known, for instance as disclosed in Laid-open Japanese Utility Model Application No. 57-127832 (1982), in which bearing caps are integrally connected by a beam member extending along a crankshaft. Also, in Laid-open Japanese Utility Model Application No. 59-110359 (1984), there is disclosed a frame member bridging both skirt portions located on opposite sides of a main bearings in a cylinder block. This frame member is fastened with the main bearing caps by bolts. Further, in Laid-open Japanese Utility Model Application 56-25041 (1981), there is disclosed a lower block which is formed by integrally connecting bearing caps.

These prior art references can increase stiffness of the support structure around the bearing beams. Through recent studies, however, it has been found that it is difficult to reduce the vibration and the torsion of bearing caps in a back-and-forth direction without increasing the thickness of the beam of the frame member in the structure of Laid-open Japanese Utility Model Application No. 57-127832 (1982). To increase the thickness of the beam of the frame results in increasing the weight of the engine.

Furthermore, it has been found that it is not desirable to manufacture the bearing cap and lower block integrally, like a structure of Laid-open Japanese Utility Model Application 56-25041 (1981), in suppressing noises, because the resonance frequency of the unit becomes lower, and echo like sounds in the range 200–500 Hz occur.

Still further, it is difficult to obtain a sufficient stiffness to prevent the deformation movement between the bearing caps and the lower block if the construction of Laid-open Japanese Utility Model Application No. 59-110359 (1984) is adopted.

Accordingly, it was very difficult to provide an integrated bearing cap unit which can accomplish both the opposite purposes of obtaining a light weight and maintaining an adequate resonance frequency.

SUMMARY OF THE INVENTION

Accordingly, it is an object of this invention to provide a crankshaft supporting structure for an internal combustion engine which is capable of obtaining a remarkable reinforcing effect by using a light weight reinforcement member.

It is another object of this invention to provide a crankshaft supporting structure for an internal combustion engine which enables to maintain a resonance frequency of bearing caps at an adequate level to suppress vibrations occurring in the crankshaft supporting structure.

In accordance with the present invention, there is provided a crankshaft supporting device for a multi-cylinder engine comprising a plurality of bulkheads provided in a cylinder block of the engine to be arranged along an axis of the crankshaft disposed in a lower part of the cylinder block. A bearing cap member has a plurality of bearing cap portions each coupled with a lower end of one of the bulkheads so as to constitute a bearing portion for supporting the crankshaft in conjunction with the bulkhead, and a pair of beam portions extends along the axis of the crankshaft to interconnect therethrough adjacent two of the bearing cap portions. A reinforcement member has a side wall portion which is coupled with a skirt portion of the cylinder block, and a plurality of bolt seats are located underneath the beam portion of the bearing cap member. A the plurality of ribs interconnect at least one of bolt seats and at least one side wall portion. A plurality of bolts fasten the beam portion with the bolt seats.

BRIEF DESCRIPTION OF THE DRAWINGS

The accompany drawings show preferred embodiments of the present invention, in which.

DETAIL DESCRIPTION OF THE PREFERRED EMBODIMENTS

First embodiment

Figure 1:
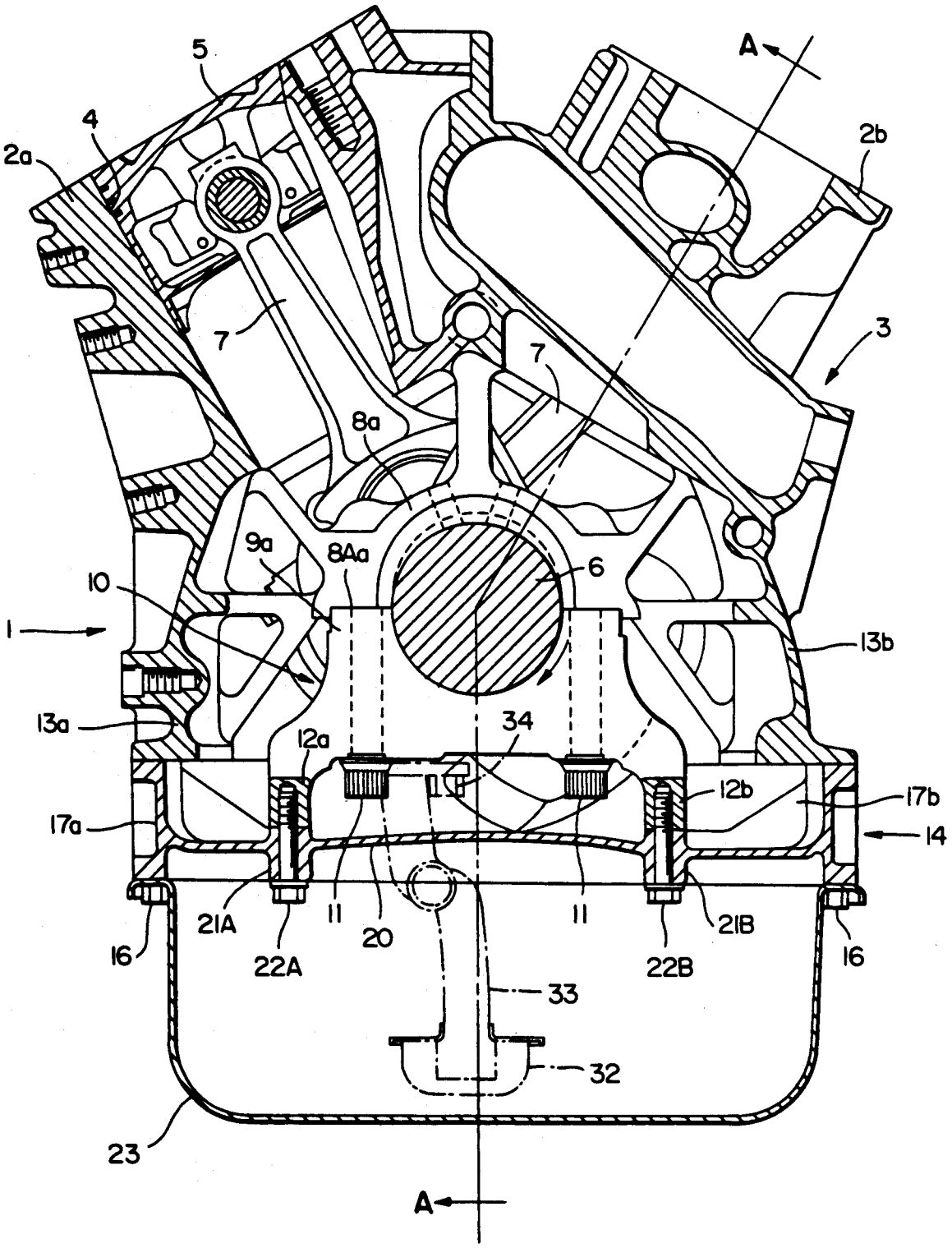
FIG. 1 is a sectional front view of the first embodiment of the crankshaft supporting structure in accordance with the present invention.

Referring now to the drawings, a engine 1 is a V-type internal combustion engine having six cylinders. The v-shaped cylinder block 2 has two banks 2*a* and 2*b*, and each bank has three in-line cylinder bores 4. A piston 5 is accommodated in each cylinder bore 4, the piston 5 is coupled with a crankshaft 6 by a connecting rod 7. The cylinder block 2 is provided with bulkheads 8*a*, 8*b*, 8*c* and 8*d* arranged at predetermined intervals along an axis of the crankshaft 6. Bearing cap portions 9*a*, 9*b*, 9*c* and 9*d* of a bearing cap member 10 are connected with lower ends 8A*a*, 8A*b*, 8A*c* and 8A*d* of the bulkheads 8*a*, 8*b*, 8*c* and 8*d*, respectively, to constitute bearing portions 10*a*, 10*b*, 10*c* and 10*d* by which the journals 6*a*, 6*b*, 6*c* and 6*d* of the crankshaft 6 are respectively supported to be rotatable. Each of the bearing cap portions 9*a*, 9*b*, 9c and 9d is connected with corresponding bulkheads 8a, 8b, 8c and 8d by a pair of cap bolts 11.

Each of the bearing cap portions 9a, 9b, 9c and 9d is connected integrally by a pair of beam portions 12a and 12b which extend along the axis of the crankshaft 6. Each beam portion 12a or 12b is located at both sides of and lower parts of the bearing cap portions 9a, 9b, 9c and 9d, and is located at an outer side of a pair of cap bolts 11.

The cylinder block 2 has skirts portions 13a and 13b. A lower block 14 is attached underneath the skirts portions 13a and 13b by means of plurality of bolts 16. The lower block 14 has two side walls 17a and 17b, a front wall 18, a rear wall 19, and a plate portion 20 which is connected normal to all of the two side walls 17a and 17b, the front wall 18 and the rear wall 19. The plate portion 20 has bolt seats 21A and 21B which are located to correspond to the beam portions 12a and 12b. The beam portions 12a and 12b are connected to the lower block 14 by bolts 22A and 22B each being screwed into the through-holes of the bolt seats 21A and 21B. Accordingly, the lower block 14 reinforces the skirt portions 13a and 13b and the bearing cap member 10 at the same time. An oil pan 23 is connected underneath the lower block 14 by bolts 16 and 24.

Figure 2:
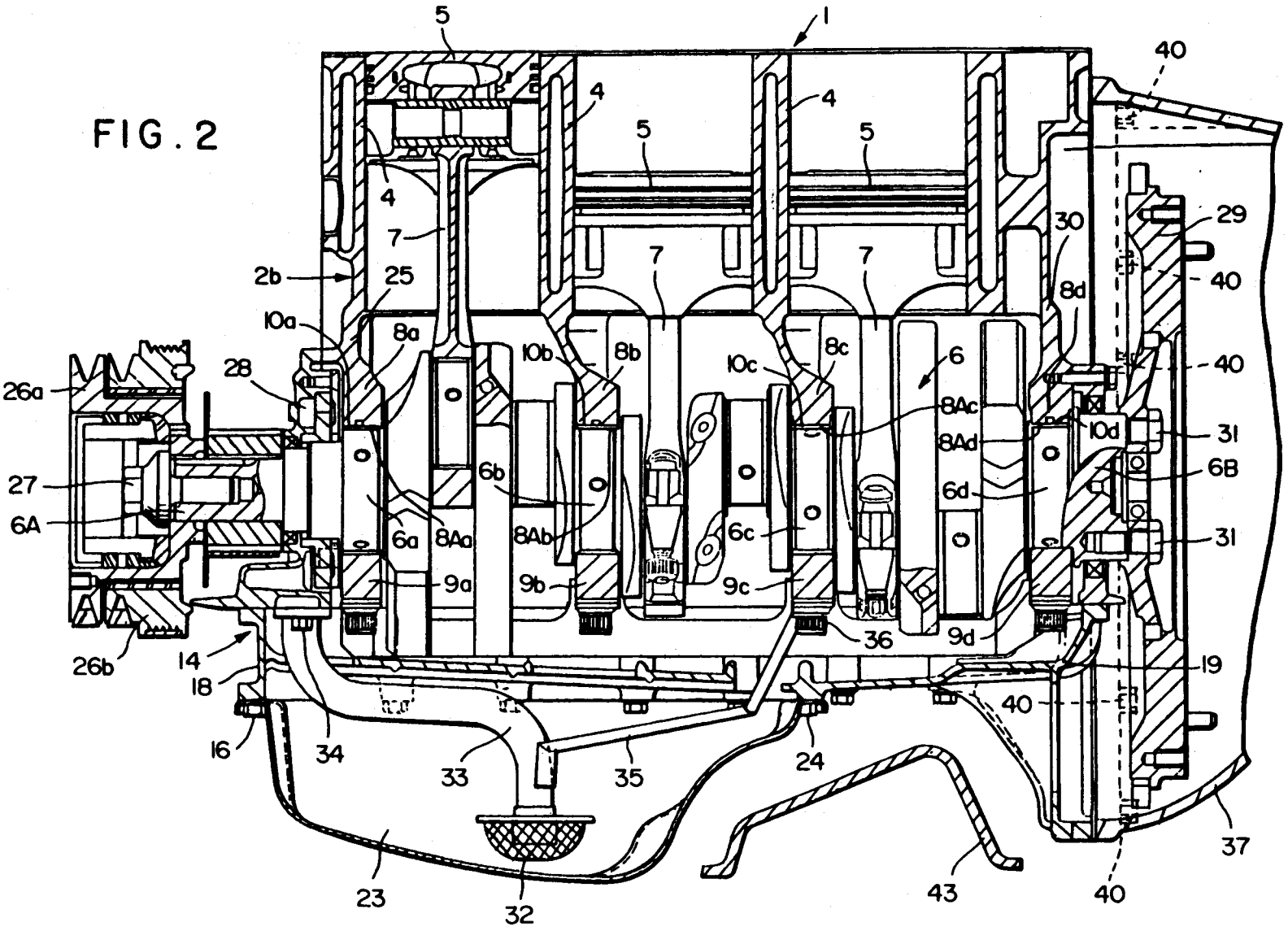
FIG. 2 is a sectional side view taken along line A—A of FIG. 1.

As shown in FIG. 2, the crankshaft 6 has a front end portion 6A which protrudes from a front wall 25 of the cylinder block 2. A pulley 26a for driving a cam shaft (not shown) and a pulley 26b for driving an alternator (not shown) are fixed on the front end portion 6A by a bolt 27. An oil pump 28 is mounted on the crankshaft 6 so as to be located between the front wall 25 and the pulleys 26a, 26b. The crankshaft 6 has a rear end portion 6B which protrudes from a rear wall 30 of the cylinder block 2. A flywheel 29 is fixed on the rear end portion 6B by a bolt 31.

The oil pan 23 is disposed so that it is located underneath the front part of the lower block 14. An oil strainer 32 is provided in the oil pan 23. The oil strainer 32 is connected to the oil pump 28 via a suction pipe 33. Numeral 34 denotes a bolt for fastening the suction pipe 33 with the oil pump 28. A lower part of the suction pipe 33 is connected to one part of the bearing cap member 10; for example, the bearing cap portion 9c, by means of a bracket 35.

Figure 3:
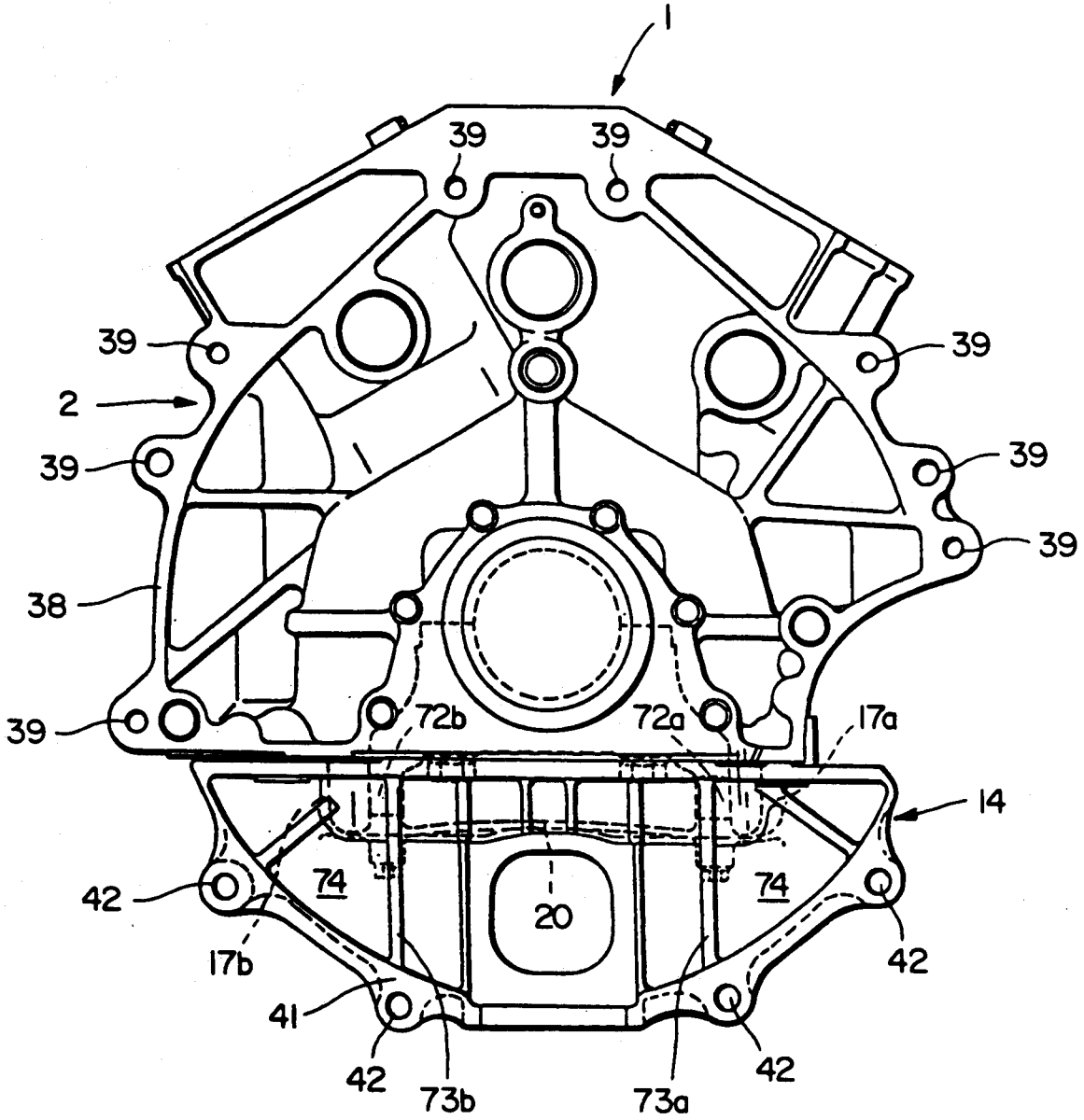
FIG. 3 is a rear end view of the first embodiment of this invention.
Figure 4:
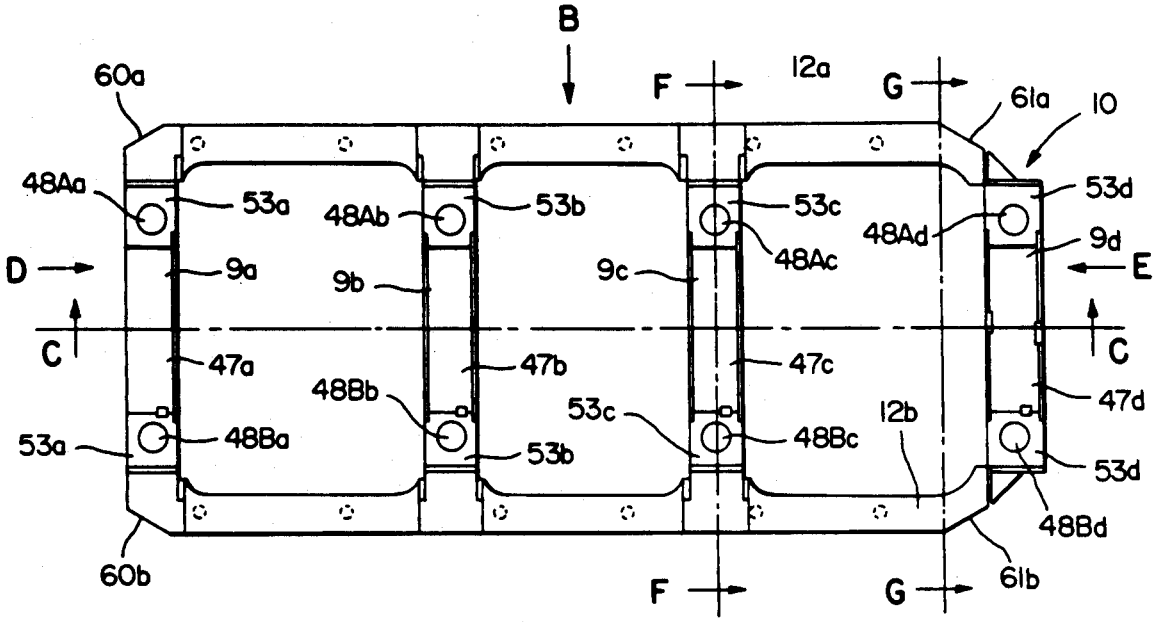
FIGS. 4 and 5 are top and bottom view of the bearing cap member of the first embodiment of this invention.

A transmission case 37 is connected on the rear side of the engine 1. As shown in FIG. 3, a connecting surface 38 having a semi-circular configuration is formed on the edge of the rear end of the cylinder block 2. On the connecting surface 38, there are provided eight through-holes 39. The transmission case 37 is connected to the rear end of the cylinder block 2 by bolts 40 so that the lower part of the transmission case 37 protrudes downward from the lower end of the cylinder block 2. The rear wall 19 is formed to be semi-circular so as to match with the configuration of the lower part of the transmission case 37. The rear wall 19 has a connecting surface 41 on its rear edge. The connecting surface 41 is located on the same plane with the connecting surface 38. On the connecting surface 41, there are provided four through-holes 42. The transmission case 37 is connected to the rear end of the lower block 14 by bolts 40 threaded into the through-holes 42. As shown in FIG. a 2, a cross member 43 for vehicle body (not shown) is located under the engine 1 so as to space the oil pan 23 and the rear wall 19. The cross member 43 is disposed normal to the crankshaft 6 in a horizontal plane Referring now to FIGS. 4–11, the bearing cap member 10 is explained in more detail. The bearing cap member 10 includes four bearing cap portions 9a, 9b, 9c and 9d which coact with the bulkheads 8a,8b,8c and 8d of the cylinder block 2 to support the crankshaft 6 rotatably therebetween, and two beam portions 12a and 12b which are integrally formed with the four bearing cap portions 9a,9b,9c and 9d so that each of the bearing cap portions 9a,9b,9c and 9d are connected at both ends by the beam portions 12a and 12b.

Figure 10:
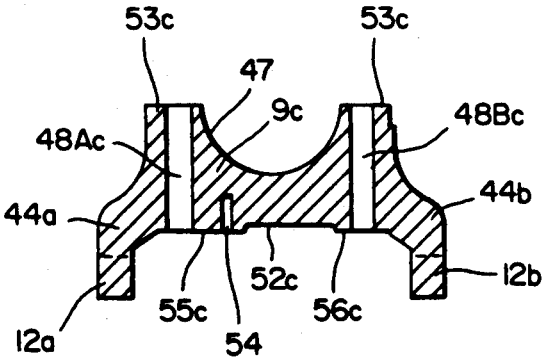
FIGS. 10 and 11 are sectional views taken along lines F—F and G—G of FIG. 4, respectively.
Figure 11:
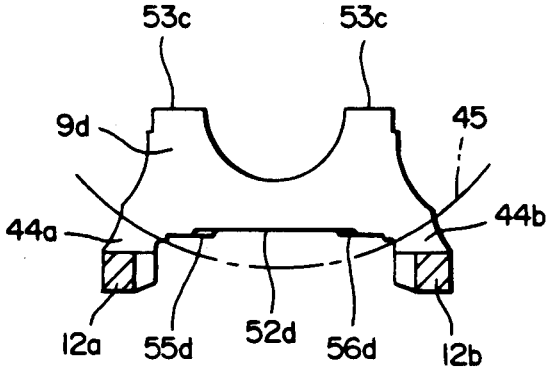
Figure 12:
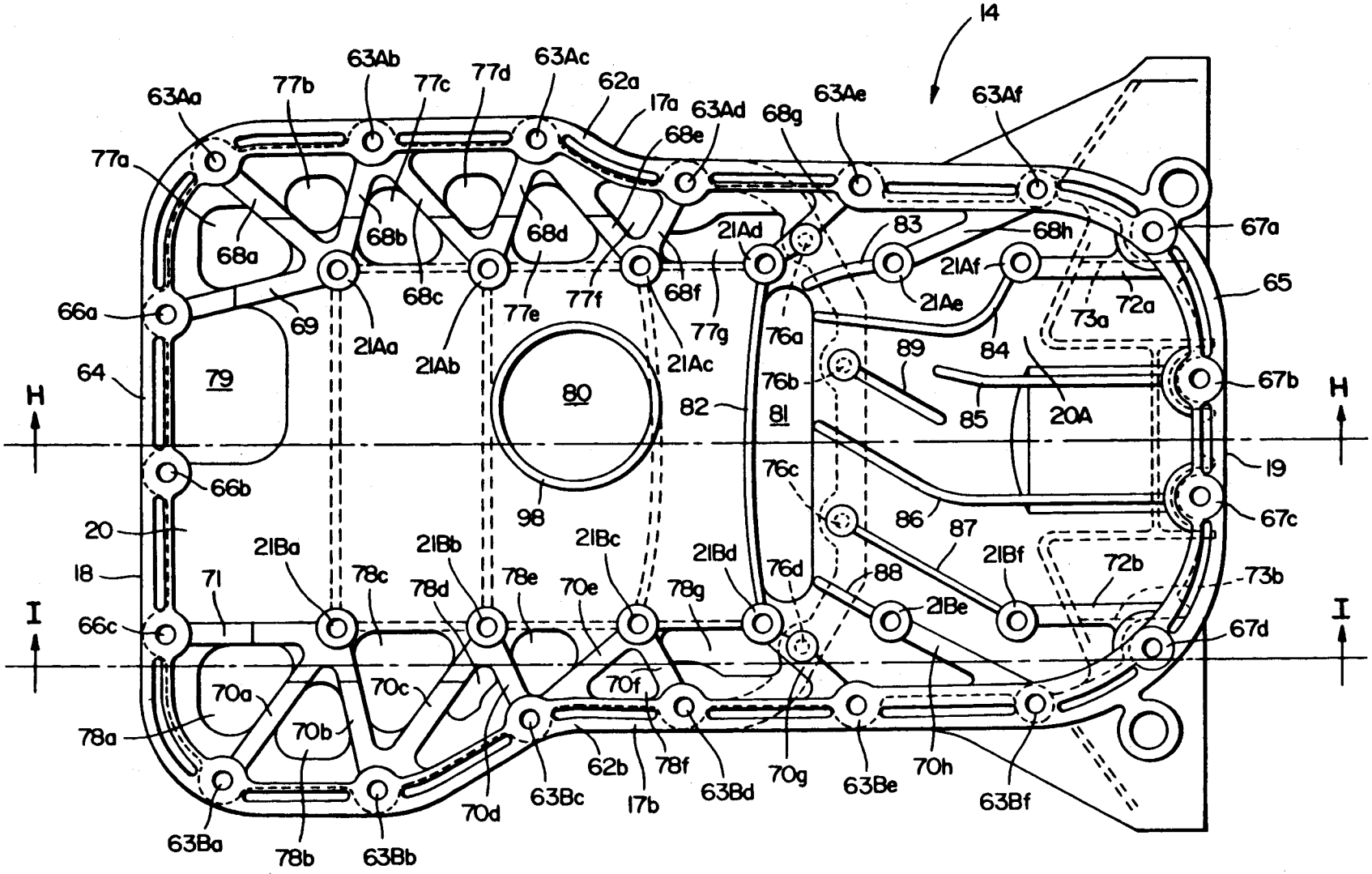
FIGS. 12 and 13 are top and bottom views of the lower block member of the first embodiment in accordance with the present invention.

As shown in FIGS. 10 and 11, there are provided connecting portions 44a and 44b to integrally connect both ends of each bearing cap portion and the beam portions 12a and 12b. The beam portions 12a and 12b have cross sections of rectangular configuration, as shown in FIG. 11. The location of the beam portions 12a and 12b are determined not to interfere with crankshaft 6. A line 45 shows a locus of the crankshaft.

Bearing portions 47a,47b,47c and 47d for supporting the crankshaft 6 are of semi-circular configuration. Through-holes 48Aa, 48Ab, 48Ac, 48Ad, 48Ba, 48Bb, 48Bc and 48Bd are provided from lower surfaces 52a, 52b, 52c and 52d to upper surfaces 53b, 53c and 53d. The beam portion 12a has a lower surface 49a, which includes holes 50a, 50b, 50c, 50d, 50e and 50f for receiving bolts 22A. The holes 50a, 50b, 50c and 50d are offset from the bearing cap portions 9a, 9b,9c and 9d. That is, the holes 50a and 50b are located between the bearing cap 9a and the bearing cap 9b, the holes 50c and 50d are located between the bearing cap 9b and the bearing cap 9c, and the holes 50e and 50f are located between the bearing cap 9c and the bearing cap 9d.

The beam portion 12b has a lower surface 49b, which includes holes 51a, 51b, 51c, 51d, 51e and 51f for receiving bolts 22B. The holes 51a, 51b, 51c and 51d are offset from the bearing cap portions 9a, 9b,9c and 9d. That is, the holes 51a and 51b are located between the bearing cap 9a and the bearing cap 9b, the holes 51c and 51d are located between the bearing cap 9b and the bearing cap 9c, and the holes 51e and 51f are located between the bearing cap 9c and the bearing cap 9d.

Figure 5:
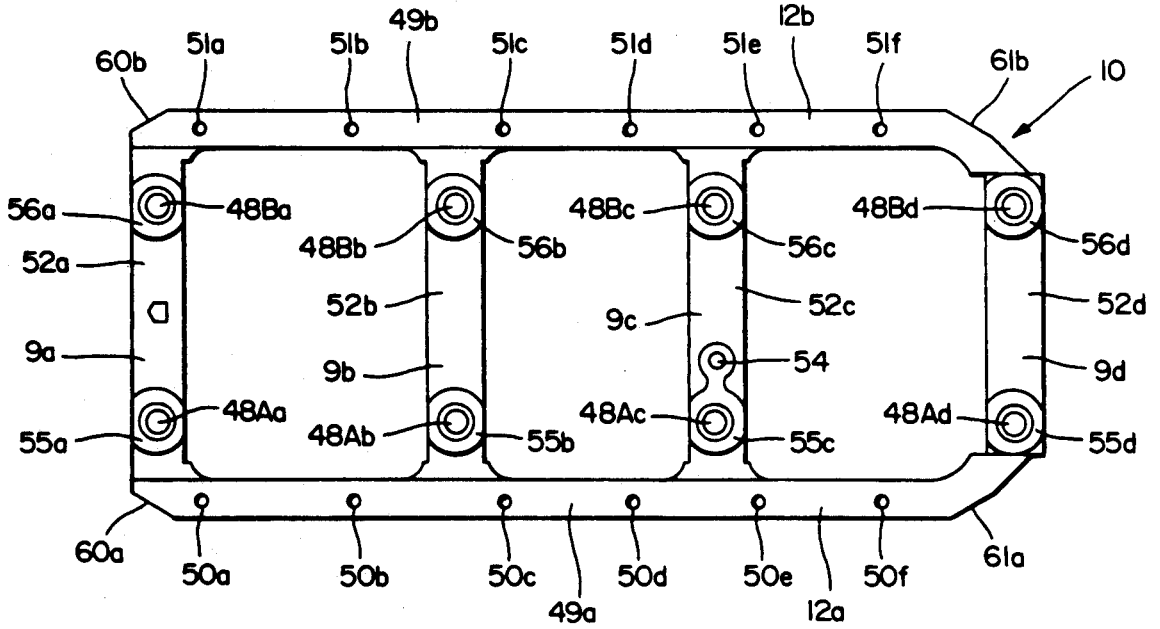
Figure 6:
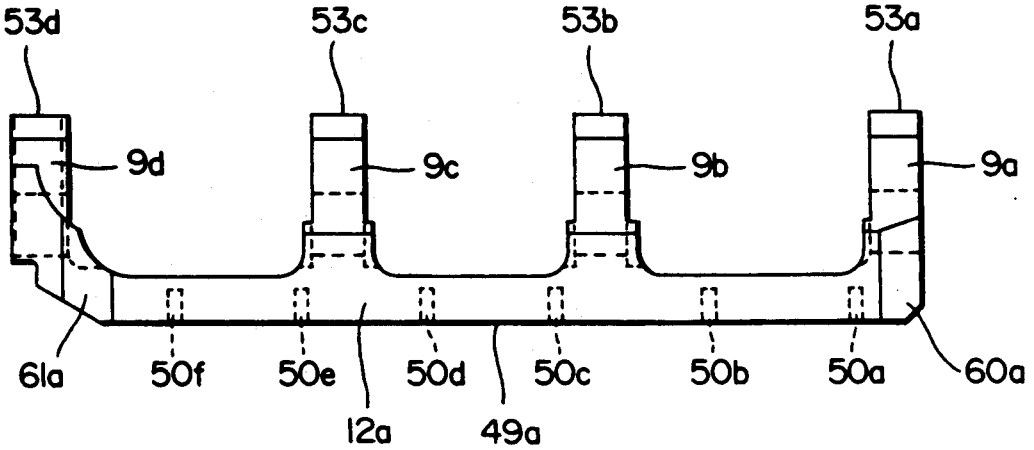
FIG. 6 is a sectional view seen from direction B of FIG. 4.
Figure 7:
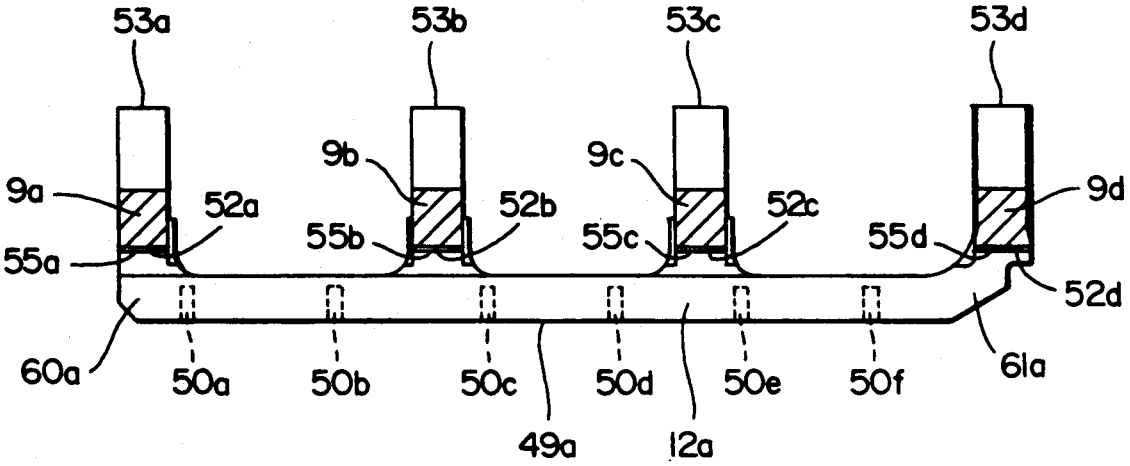
FIG. 7 is a sectional viewtaken along line C—C of FIG. 4.
Figure 8:
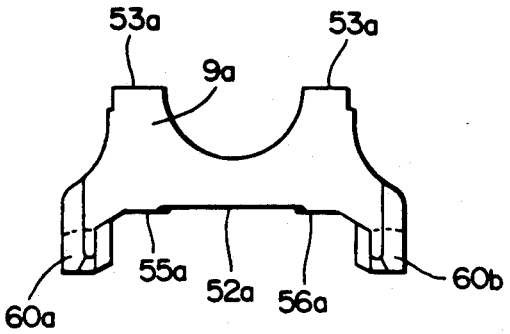
FIGS. 8 and 9 are sectional views seen from directions D and E of FIG. 4, respectively.
Figure 9:
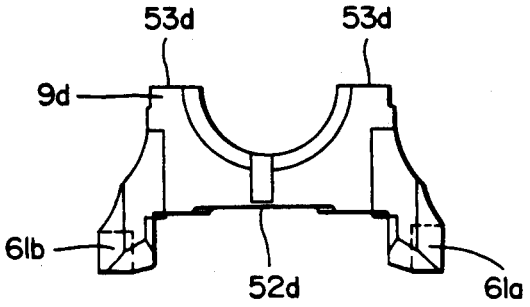

As shown in FIGS. 5 and 10, the bearing cap portion 9c which is the third bearing cap portion from the front end of the engine has a lower surface 52c. This lower surface 52c has the through-hole 48Ac and a hole 54 for receiving the bolt 36 that fastens the bracket 35 for the oil strainer 32. Boss portions 55a, 55b, 55c, 55d, 56a, 56b, 56c and 56d are provided around the through-holes 48Aa, 48Ab, 48Ac, 48Ad, 48Ba, 48Bb, 48Bc and 48Bd. The boss 55c extends to cover both the through-hole 48Ac and the hole 54.

Front ends 60a, 60b and rear ends 61a, 61b of the beam members 12a, 12b are cut out obliquely at outer edges and lower edges. The rear ends 61a and 61b are also bent inwardly.

Referring now to FIGS. 12–16, the lower block 14 is explained in detail. The lower block 14 comprises a pair of opposite side walls 17a and 17b, the front wall 18, the rear wall 19 and the plate portion 20. The side walls 17a and 17b have connecting surfaces 62a and 62b to be fitted with the lower ends of the skirts 13a and 13b of the cylinder block 2. On the connecting surfaces 62a and 62b, there are provided a plurality of through-holes 63Aa, 63Ab, 63Ac, 63Ad, 63Ae, 63Af and 63Ba, 63Bb, 63Bc, 63Bd, 63Be, 63Bf, at predetermined intervals. The lower block 14 is connected to the skirts 13a, 13b by the bolt 16 inserted into the through-holes 63A, 63B, as shown in FIG. 1.

The front wall 18 has a connecting surface 64 to be fitted with the lower end of the front wall 25 of the cylinder block 2, The rear wall 19 has a connecting surface 65 to be fitted with the lower end of the rear wall of the cylinder block 2. These connecting surfaces 64 and 65 are formed continuously with the connecting surfaces 62*a* and 62*b*, and have a plurality of through-holes 66*a*, 66*b*, 66*c* and 67*a*, 67*b*, 67*c*, 67*d* at predetermined intervals.

Figure 14:
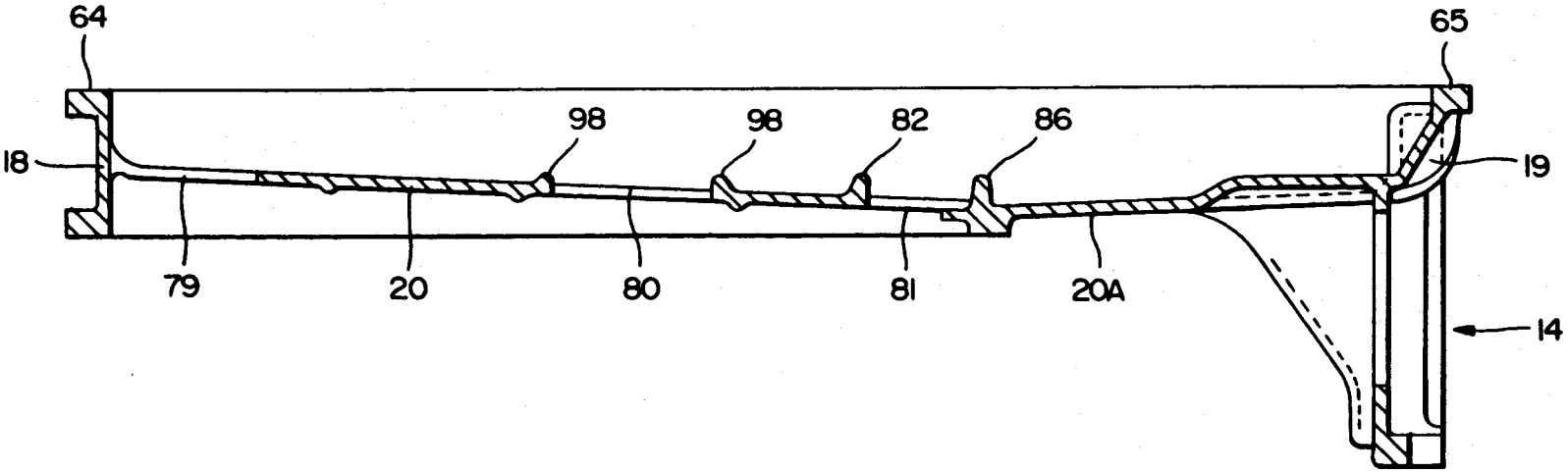
FIGS. 14 and 15 are sectional views taken along lines H—H and I—I of FIG. 12, respectively.
Figure 15:
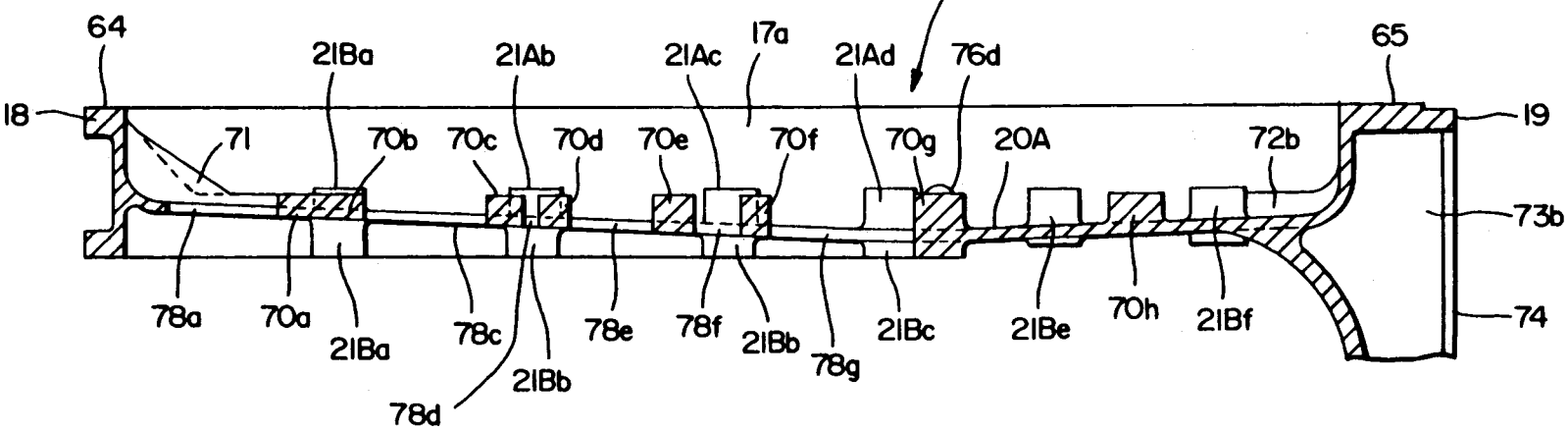

The plate portion 20 partitions the inside space of the lower block 14 into an upper part and a lower part, as shown in FIGS. 14 and 15. On the plate portion 20, there are provided a group of bolt seats 21A*a*, 21*a*B, 21A*c*, 21A*d*, 21A*e*, 21A*f*, which are located adjacent to the side wall 17*a*, and a group of bolt seats 21B*a*, 21B*b*, 21B*c*, 21B*d*, 21B*e*, 21B*f* which are located adjacent to the side wall 17*b* at predetermined intervals, respectively.

A plurality of ribs 68*a*–68*h* are provided on the plate portion 20 so as to connect the bolt seats 21A with the portions in which the through-holes 63A*a*–63A*f* are formed. The front end bolt seat 21A*a* is also connected with the front wall 18 at the portion that the through-hole 66*a* is formed by means of a rib 69 provided on the plate portion 20. The rear end bolt seat 21A*f* is also connected with the rear wall 19 at the portion that the through-hole 67*a* is formed by means of a rib 72*a*.

A plurality of ribs 70*a*–70*h* are provided on the plate portion 20 so as to connect the bolt seats 21B with the portions in which the through-holes 63B*a*–63B*f* are formed. The front end bolt seat 21B*a* is also connected with the front wall 18 at the portion that the through-hole 66*c* is formed by a rib 71 provided on the plate portion 20. The rear end bolt seat 21B*f* is also connected with the rear wall 19 at the portion that the through-hole 67*d* is formed by means of a rib 72*b*. The ribs 69, 71, 72*a* and 72*b* are located along the axis of the crankshaft 6.

As shown in FIG. 15, a recess 74 is provided in the rear wall. In the recess 74, there are provided a pair of ribs 73*a* and 73*b* which are formed so as to meet the ribs 72*a* and 72*b*, respectively That is, the rib 73*a* is located underneath the rib 72*a*, and the rib 73*b* is located underneath the rib 72*b*. The ribs 73*a* and 73*b* are connected to the upper end 65 of the rear wall 19, and extend towards the bolt seats 21A*f* and 21B*f*, respectively.

Figure 13:
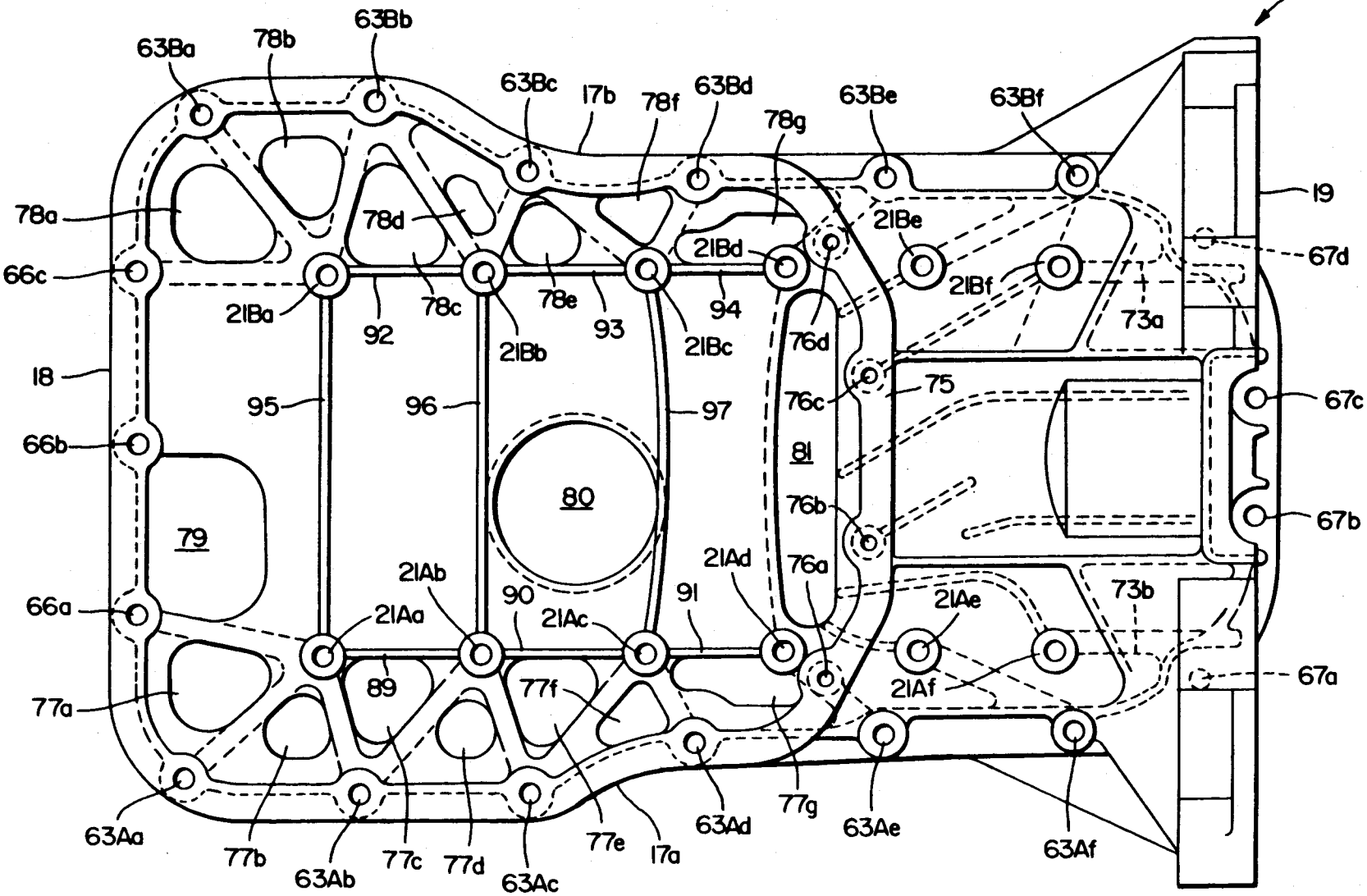

As shown in FIG. 13, the lower block 14 has a connecting surface 75 to be fitted to the oil pan 23. The oil pan 23 is attached to the lower block 14 by the bolts 16 and 24 which are inserted into the through-holes 63A*a*–63A*d*, 63B*a*–63B*d*, 66*a*–66*c*, and holes 76*a*–76*d*.

The ribs 68*a*–68*f* are designed so as to create a zigzag pattern. A plurality of oil drain ports 77*a*–77*g* are formed on the plate portion 20 between the ribs 68*a*–68*b*. Also, the ribs 70*a*–70*f* are designed so as to create a zigzag pattern. A plurality of oil drain ports 78*a*–78*g* are formed on the plate portion 20 between the ribs 70*a*–70*b*.

Along the longitudinal axis of the lower block 14, there are further three oil drain ports 79,80 and 81. The front end oil drain port 79 is located close to the rib 69. The center oil drain port is located slightly close to the side wall 17*a*. The rear oil drain port 81 opens from the bolt seat 21A*d* to the bolt seat 21B*d*, which mainly collects the oil on the rear part 20A of the plate portion 20. In front of the rear oil drain port 81, a partition wall 82 is provided between the bolt seats 21A*d* to 21B*d*.

A thin rib 83 is provided on the rear part 20A so as to extend from the bolt seat 21A*e* to the rear oil drain port 81 along the axis of the rib 68*h*. A thin and L-shaped rib 84 is provided on the rear part 20A so as to extend from the bolt seat 21A*f* to the rear oil drain port 81. A thin rib 85 is provided on the rear part 20A so as to extend frontward from the boss 67*b* and to terminate at the intermediate portion of the rear part 20A. A thin rib 85 is provided on the rear part 20A so as to extend frontward from the boss 67*b* and to terminate at the intermediate portion of the rear part 20A. A thin rib 86 which is slightly bent toward side wall 17*a* and is provided on the rear part 20A so as to extend from the boss provided on the rear part 20A so as to connect the bolt seat 21B*f* and the hole 76*c*. A straight thin rib 88 is provided on the rear part 20A so as to extend from the bolt seat 21B*e* to the rear oil drain port 81 along the axis of the rib 70*h*. A thin and short rib 89 is provided on the rear part 20A so as to extend rearward from the hole 76*b* toward the side wall 17*b* and to terminate at the intermediate portion of the rear part 20A. And, a circular rib 98 is formed around the center oil drain hole 80.

As shown in FIG. 13, on the bottom of the lower block 14, there are provided ribs 89, 90 and 91 which connect the bolt seats 21A*a*, 21A*b*, 21A*c* and 21A*d*, and ribs 92, 93 and 94 which connect the bolt seats 21B*a*, 21B*b*, 21B*c* and 21B*d*. Also, there is provided a rib 95 connecting the bolt seat 21A*a* and the bolt seat 21B*a*, a rib 96 connecting the bolt seat 21A*b* and the bolt seat 21B*b*, and a rib 97 connecting the bolt seat 21A*c* and the bolt seat 21B*c*. Each of the ribs 89–97 is thin. The rib 97 is curved to extend around the center oil drain port 80.

As can be seen in FIG. 1, the plate portion 20 is slightly bent upward between the bolt seats 21A*a*–21A*d* and the bolt seats 21B*a*–21B*d*.

Merits of the first embodiment

In accordance with the above described first embodiment, it is possible to reduce torsion of the bearing cap portions 9*a*, 9*b*, 9*c* and 9*d* generated in a back-and-forth direction by the combustion forces transmitted via crankshaft 6, because the bearing cap member 10 is formed by connecting the bearing beam portions 9*a*, 9*b*, 9*c* and 9*d* integrally to the two beam portions 12*a*, 12*b*. It is possible to increase the stiffness of the cylinder block 2, because the skirts portion 13*a*, 13*b* are connected by the lower block 14, which results in a reduction of vibrations. By fastening the lower block 14 and the portions 9 and lower block 14 is increased further as a total.

The ribs 68*a*–68*h*, 70*a*–70*h*, 69, 71, 72*a* and 72*b* are located mainly to connect the bolt seats 21A*a*–21A*f*, 21B*a*–21B*f* to the adjacent side walls 17*a*, 17*b*. By doing so, forces transmitted from the bearing cap portions 9 to the lower block 14 are effectively received without increasing the thickness of the plate portion 20. In addition, since the bearing cap portions 9 and the lower block 14 are separately manufactured, the resonance frequencies of the bearing cap portions 9 and the lower block 14 become high enough to suppress resonance vibration of the engine as a whole.

There is intentionally provided no rib between each of bolt seats 21A*a*–21A*f*. Also, there is intentionally provided no rib between each of bolt seats 21B*a*–21B*f*. The effect of the elimination of the ribs between the bolt seats 21A*a*–21A*f*, 21B*a*–21B*f* is that the mechanical friction between the bearing portions 9 and the crankshaft 6 is reduced because the torsion of the crankshaft 6 is only a small amount. The bolts 22A, 22B are intentionally located outside of the side ends of the bearing cap portions 9 in order to allow both torsioning of the bearing cap portions 9 in a back-and-forth direction and bending of the beam portions 12*a*, 12*b* in an up-and-down direction.

Since the plate portion 20 is formed to be bent upward at a Center portion, oil on the plate portion 20 flows smoothly into the oil drain ports 77*a*–77*g*.

Since the rear wall 19 of the lower block 14 has the Connecting surface 41 to be connected to the transmission case 37, the bearing cap portions 9 are integrally connected with the transmission case 37. The ribs 72*a*, 72*b*, 73*a* and 73*b* formed on the rear wall 19 increase the stiffness against the twisting motion occurring on the rear part 20A, which results in a decrease of the power plant bending. The ribs 68*h*, 83, 72*a*, 84, 85, 86, 87, 72*b*, 70*h* and 88 function as both reinforcement members and oil guides. The suction pipe 33 and bracket 35 are inserted into the oil drain ports 79 and 80, respectively.

As can be seen in FIG. 1, the crankshaft 6 rotates in the direction of arrow @. On the other hand, the oil strainer 32 is offset toward the side wall 17*a*. The bubbles caused by the mixing of oil generated by the rotation of the crankshaft 6 gather chiefly in the side wall 17*b*. Therefore, the oil strainer 32 is located far from the bubbles in order not to intake the bubbles.

Second embodiment

Figure 16:
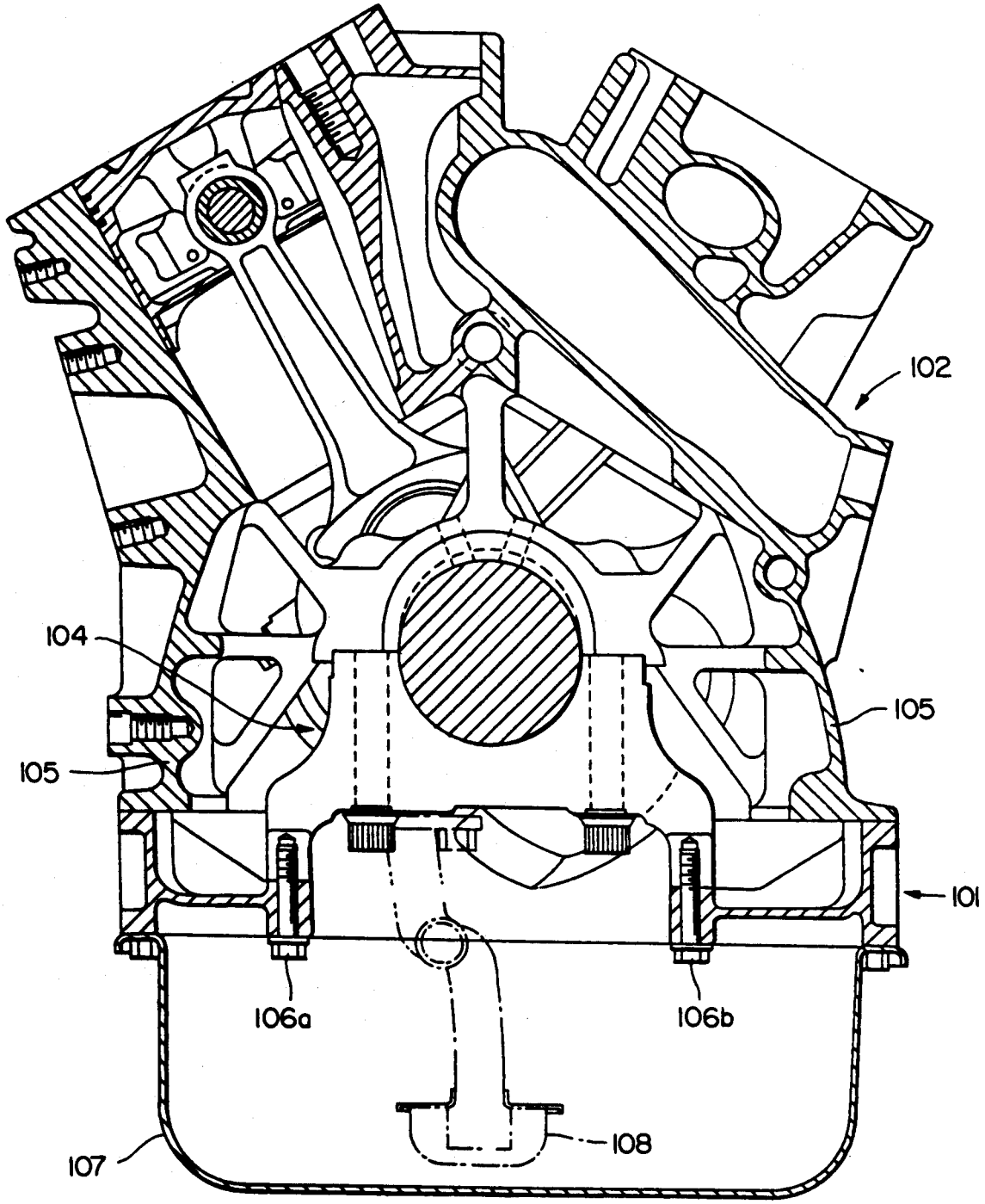
FIG. 16 is a sectional view of the second embodiment of the crankshaft supporting structure in accordance with the present invention.
Figure 17:
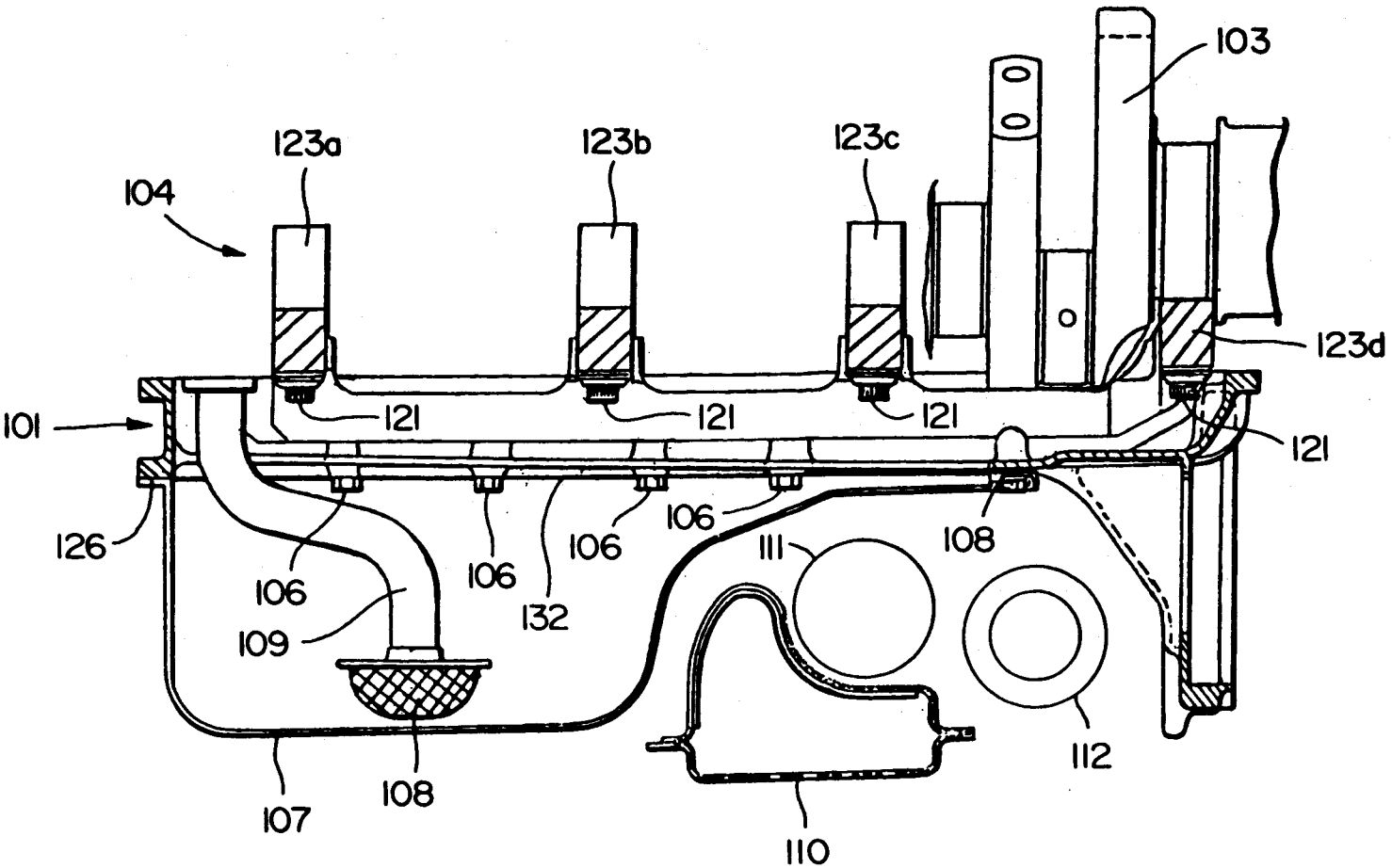
FIG. 17 is a sectional view of the second embodiment.
Figure 18:
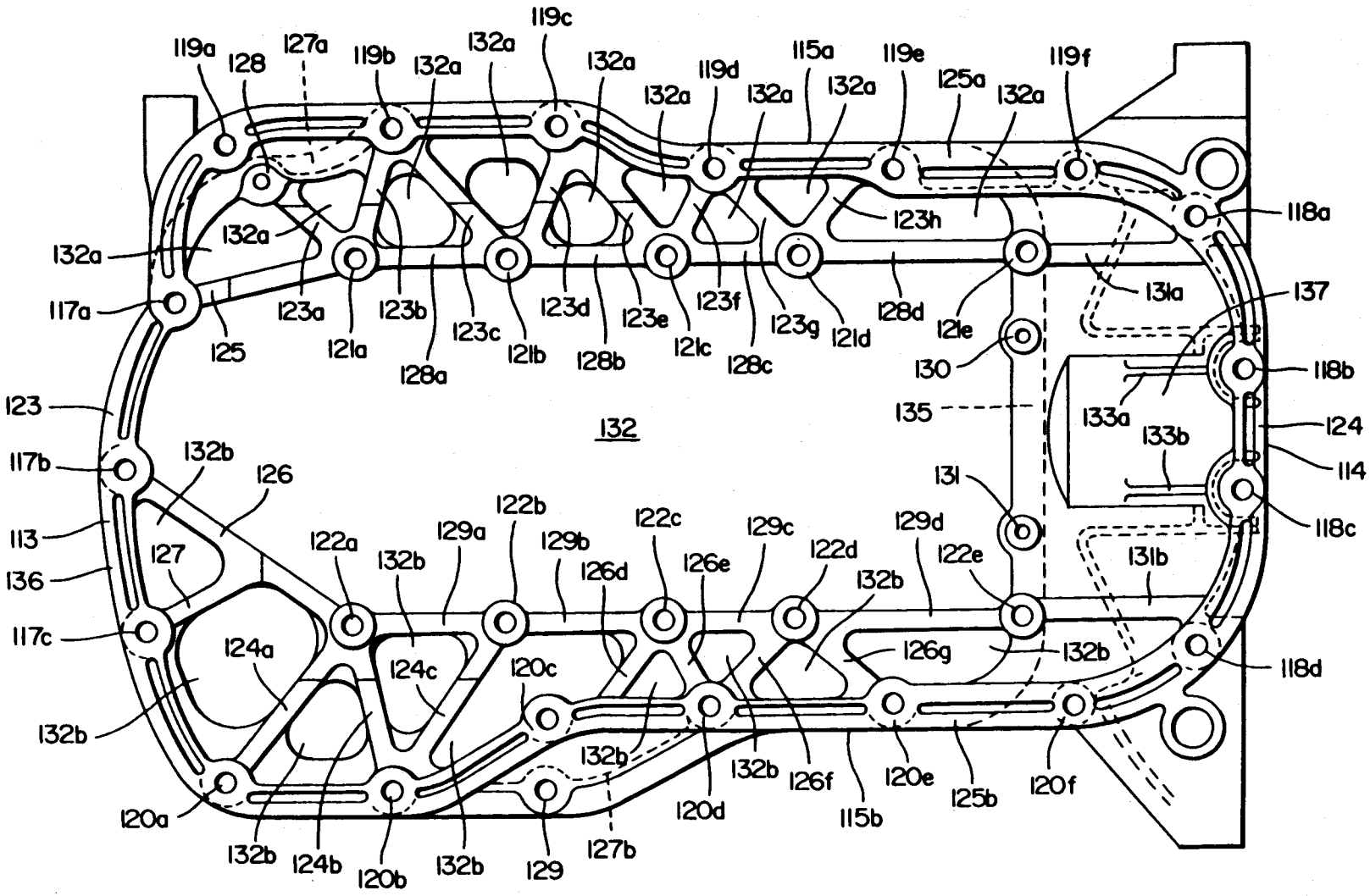
FIG. 18 is a top view of the lower block member of the second embodiment of this invention.

Referring now to FIGS. 16 to 18, the second embodiment is different from the first embodiment in the Construction of a lower block 101. A cylinder block 102, a crankshaft 103 and a bearing cap element 104 are substantially the same as the first embodiment.

The lower block 101 is connected to the bottom of the skirts portion 105 of the cylinder block 102, and is connected with the bearing cap element 104 by bolts 106*a*, 106*b*. An oil pan 107 is connected under the lower part of the lower block 101. The lower block 101 is connected to a transmission case (not shown) at the rear end thereof. An oil strainer 108 is connected to an oil pump not shown) by means of a suction pipe 109. A cross member 110, a steering rack 111 and a rack for four wheel steering 112 are located between the oil pan 107 and the rear portion of the lower block 101

The lower block 101 includes, as shown in FIG. 18, a front wall 113, a rear wall 114, a pair of side walls 115*a*, 115*b*, and a plate portion 116 disposed therebetween. Connecting surfaces 123, 124, 127*a* and 127*b* are formed on the upper portion of the front wall 113, the rear wall 114, and side walls 115*a*, 115*b*. Bosses 117, bosses 118, bosses 119 and bosses 120 are provided on the front wall 113, the rear wall 114, and the side walls 115*a*, 115*b* respectively.

Bosses 121*a*–121*e* are formed adjacent to the side wall 115*a* to connect the bearing cap element 104 by bolts 121. Bosses 122*a*–122*e* are formed adjacent to the side wall 115*b* to connect the bearing cap element 104 by bolts 121. The bosses 121*a*, 121*b*, 122*a* and 122*b* are located between the beam cap portion 123*a* and 123*b*. The bosses 121*c*, 121*d* 122*c* and 122*d* are located between the beam cap portion 123*b* and 123*c*. The bosses 121*e*, 121*f* 122*e* and 122*f* are located between the beam cap portion 123*c* and 123*d*. For connecting the oil pan 107, a connecting surface 136, connecting surfaces 127*a*, 127*b*, and a connecting surface 124 are formed at bottom of the front wall 113, the side walls 115*a* and 115*b*, and the rear wall 114, respectively. Bosses 117, 119*b*, 119*c*, 119*d*, 119*e*, 120*a*, 120*b*, 120*c*, 120*d* and 120*e* are used for connecting both the oil pan 107 and the lower block 101 to the cylinder block 102, and bosses 128 on the side wall 115*a*, a boss 129 on the side wall 115*b*, and bolt seats 130, 131 on the rear connecting surface 135 are used for connecting the oil pan 107 to the lower block 101. An oil drain port 132 is widely opened from the front wall 113 to the rear edge of the oil pan 107 in the back-and-forth direction, from the bolt seats 121 to the bolt seats 122 in the left-and-right direction.

A rib 123*a* is provided to connect a boss 121*a* and a boss 128. A rib 123*b* is provided to connect a boss 121*a* and a boss 119*b*. A rib 123*c* is provided to connect a boss 119*b* and a boss 121*b*. A rib 123*d* is provided to connect a boss 121*b* and a boss 119*c*. A rib 123*e* is provided to connect a boss 119*c* and a boss 121*c*. A rib 123*f* is provided to connect a boss 121*c* and a boss 119*d*. A rib 123*g* is provided to connect a boss 119*d* and a boss 121*d*. A rib 123*h* is provided to connect a boss 121*d* and a boss 119*e*.

A rib 124*a* is provided to connect a boss 122*a* and a boss 120*a*. A rib 124*b* is provided to connect a boss 122*a* and a boss 120*b*. A rib 124*c* is provided to connect a boss 120*b* and a boss 122*b*. A rib 126*e* is provided to connect a boss 122*c* and a boss 120*d*. A rib 126*f* is provided to connect a boss 120*d* and a boss 122*d*. A rib 126*g* is provided to connect a boss 122*d* and a boss 120*e*. And, a rib 126*d* is provided to connect the boss 122*c* and a intermediate position between a boss 120*c* and the boss 120*d*.

Furthermore, a rib 125 is provided to connect the boss 121*a* and a boss 117*a* on the front wall 113. A rib 126 is provided to connect the boss 122*a* and a boss 117*b* on the front wall 113. A rib 127 is provided to connect a boss 117*c* and a intermediate position of the rib 126. Ribs 128*a*, 128*b*, 128*c* and 128*d* are provided to connect the bolt seats 121*a*, 121*b*, 121*c*, 121*d* and 121*e*. Ribs 129*a*, 129*b*, 129*c* and 129*d* are provided to connect the bolt seats 122*a*, 122*b*, 122*c*, 122*d* and 122*e*.

On the rear part 137 of the lower block 101, a rib 131*a* connects the bolt seat 121*e* and a bolt seat 118*a* on the rear wall 114. A rib 131*b* connects the bolt seat 122*e* and a bolt seat 118*d* on the rear wall 114.

Oil drain ports 132*a* are formed between the ribs 123. Oil drain ports 132*b* are formed between the ribs 124. On the rear part 137 of the lower block 101, ribs 133*a* and 133*b* are provided to extend forward and to terminate at the intermediate portion of the rear part 137 from the bolt seat 118*b* and 118*c*, respectively.

Merits of the second embodiment

There are provided two straight reinforcement structures formed by continuously connected ribs; i.e. a straight line of the ribs 128*a*–128*d* and the rib 131*a*, and a straight line of the ribs 129*a*–129*d* and 131*b*. By this structure, it becomes possible to increase the stiffness of the bearing cap element 104 in the direction of the axis of the crankshaft 103. Also, since the ribs 131*a* and 131*b* are connected to the rear wall 114 which is connected with the transmission case (not shown), it is possible to decrease power plant bending.

We claim:

1. A crankshaft supporting structure for a multi-cylinder engine comprising:

a plurality of bulkheads provided in a cylinder block of the engine to be arranged along an axis of a crankshaft disposed in a lower part of the cylinder block;

a bearing cap member having a plurality of bearing cap portions each coupled with a lower end of one of the bulkheads so as to form a bearing portion for supporting the crankshaft in conjunction with the bulkhead, and a pair of beam, portions extending along the axis of the crankshaft to interconnect two adjacent bearing cap portions;

a reinforcement member having a side wall portion coupled with a portion of the cylinder block;

a plurality of bolt seats located underneath the beam portions of the bearing cap member;

a plurality of ribs interconnecting one of the bolt seats and the side wall portions; and a plurality of bolts each fastening the beam portions and the bolt seats to the cylinder block.

2. A crankshaft supporting structure in accordance with claim 1, wherein the beam portions interconnect all of said bearing cap portions.

3. A crankshaft supporting structure in accordance with claim 2, wherein said bolts fasten the beam portions and the lower block at points outside of side edges of the bearing cap portions.

4. A crankshaft supporting structure in accordance with claim 1, wherein said beam portions of the bearing cap member are located under a bottom surface of the bearing cap portions, and outside of the side surface of the bearing cap portion, said bearing cap portions and said beam portions are connected by connecting portions.

5. A crankshaft supporting structure in accordance with claim 1, wherein said ribs are provided between bolt seats fitted to the bearing cap member and bolt seats fitted to the skirt portion of the cylinder block.

6. A crankshaft supporting structure in accordance with claim 5, wherein said bolt seats fitted to the bearing cap member are offset from said bolt seats fitted to the skirt portion so that the ribs form a zigzag pattern in an axial direction of the crank shaft.

7. A crankshaft supporting structure in accordance with claim 6, wherein an oil drain port is located between the ribs.

8. A crankshaft supporting structure in accordance with claim 1, wherein said lower part of the cylinder block has two side wall portions connected underneath the skirt portions of the cylinder block, a front wall of the cylinder block, a rear wall portion connected underneath a rear wall of the cylinder block, and a plate portion interconnecting the two side wall portions, the front wall portion and the rear wall portion.

9. A crankshaft supporting structure in accordance with claim 8, wherein an oil pan is connected under the lower part of the cylinder block, and an oil drain port for draining oil to the oil pan is on the plate portion.

10. A crankshaft supporting structure in accordance with claim 9, wherein an oil strainer is provided in the oil pan, said oil strainer is connected to an oil pump disposed in the cylinder block by a suction pipe, said suction pipe is located in said oil drain port.

11. A crankshaft supporting structure in accordance with claim 8, wherein a front end bolt seat of the bolt seats is connected with the front wall portion of the lower part of the cylinder block by a rib.

12. A crankshaft supporting structure in accordance with claim 8, wherein a rear end bolt seat of the bolt seats is connected with the rear wall portion of the lower part of the cylinder block by a rib.

13. A crankshaft supporting structure in accordance with claim 8, wherein a rear end surface of the rear wall portion has a connecting surface able to be fitted to a transmission case.

14. A crankshaft supporting structure in accordance with claim 13, wherein a rear end bolt seat of the bolt seats is connected with the rear wall portion of the lower part of the cylinder block by a rib.

15. A crankshaft supporting structure in accordance with claim 8, wherein an intermediate portion of the plate portion located between the bolt seats to be fitted to one side of the bearing cap portions and the bolt seats to be fitted to the other side of the bearing cap portions is curved upward.

16. A crankshaft supporting structure in accordance with claim 15, wherein an oil pan is connected under the lower part of the cylinder block, and an oil drain port for draining oil is located between the ribs.

17. A crankshaft supporting structure in accordance with claim 12, wherein an oil pan is connected to the front portion of the lower part of the cylinder block, an oil drain port is opened on the plate portion at a part close to the rear end of the oil pan, and the rib is formed to guide oil to the oil drain port.

18. A crankshaft supporting structure in accordance with claim 8, wherein a straight rib is provided to interconnect the bolt seats in the axial direction of the crank shaft.

19. A crankshaft supporting structure in accordance with claim 18, wherein an oil drain port is open in the plate portion from the bolt seats located on one side to the bolt seats located the other side of the cylinder block.

20. A crankshaft supporting structure in accordance with claim 18, wherein said bolt seats are connected substantially by a straight rib extending from the front wall portion of the cylinder block and the rear wall portion of the cylinder block.

* * * * *